US005536196A

United States Patent [19]

Sternberg

[11] Patent Number: 5,536,196

[45] Date of Patent: Jul. 16, 1996

[54] DRINKING VESSEL WITH SOUND EFFECTS

[75] Inventor: Harry W. Sternberg, Huntingdon Valley, Pa.

[73] Assignee: Fun-Damental Too Ltd., Huntingdon Valley, Pa.

[21] Appl. No.: 514,907

[22] Filed: Aug. 14, 1995

[51] Int. Cl.[6] ..... A63H 5/00; B65D 77/00

[52] U.S. Cl. ..... 446/81; 446/484; 206/217; 215/400

[58] Field of Search ..... 446/81, 484, 175, 446/71, 397; 215/400, 387, 386, 11.1; 206/217, 527; 84/600, 639, 94.2, 95.2; 472/56, 53

[56] References Cited

U.S. PATENT DOCUMENTS 3,655,325 4/1972 Toppel ..... 472/56 X
4,737,134 4/1988 Rumsey ..... 446/175 X
4,765,465 8/1988 Yamada et al. ..... 206/217
5,344,034 9/1994 Eagan ..... 84/600 X

*Primary Examiner*—Mickey Yu
*Attorney, Agent, or Firm*—Gregory J. Gore

[57] ABSTRACT

A drinking vessel, preferably a beer mug, includes a sound-generating circuit in the base of the mug which produces a "burping" sound effect. An actuation switch is located in the base which is responsive to the proximity between the bottom of the mug and a support surface upon which it rests. The sound-generating circuit is housed in a bottom portion of the mug which is releasably affixed to the fluid-containing top portion by interlocking lugs and slots. The "burping" sound effect is played only when the vessel is put down on a support surface.

7 Claims, 3 Drawing Sheets

FIG. 1
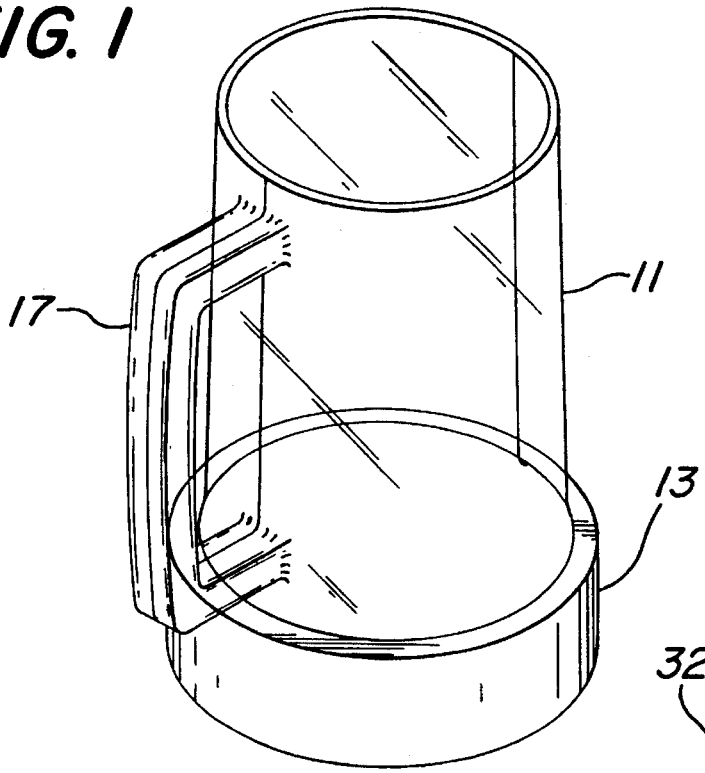
FIG. 5
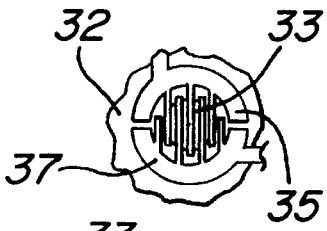
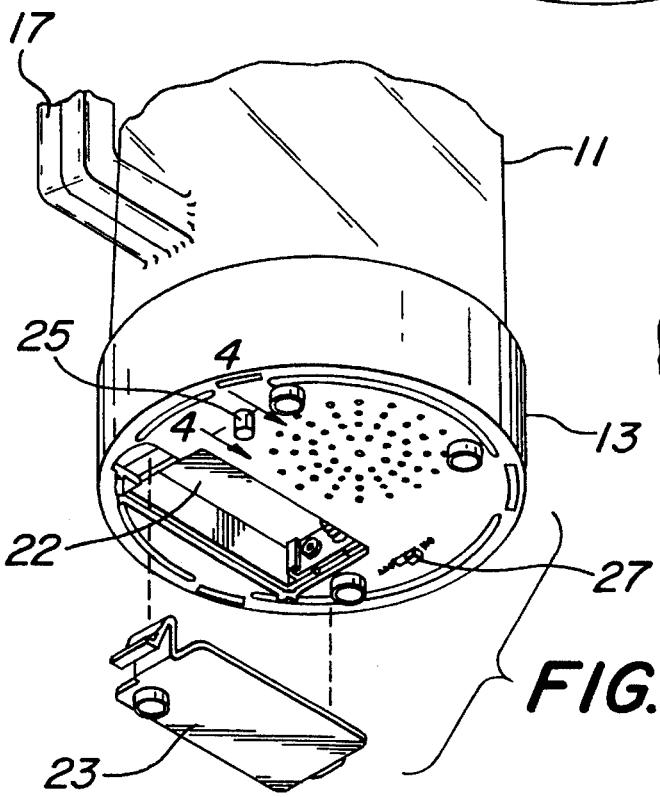
FIG. 3
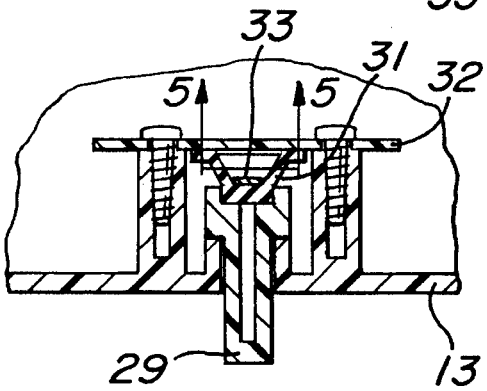
FIG. 4

DRINKING VESSEL WITH SOUND EFFECTS

FIELD OF THE INVENTION

This present invention relates to field of drinking utensils having sound-producing elements. More specifically, it relates to a drinking mug having a sound-generating, sound-effect circuit.

BACKGROUND OF THE INVENTION

The advent of inexpensive, sound-generating circuits have made them available for use in many different types of novelty items, such as children's toys and greeting cards, in order to give them the capability of being a "talking" novelty item. The sound-generating circuits may produce either a spoken phrase, musical melody, or sound effects.

The most pertinent patent prior art of which the applicant is aware is U.S. Pat. No. 4,765,465 issued to Yamada et al on Aug. 23, 1988. This patent discloses a ceramic cup having a sound-generating circuit at the bottom to produce a melody when the cup is lifted up. The circuit is permanently sealed to the bottom of the cup beneath a cast synthetic resin. U.S. Pat. No. 3,627,161 issued to Wergeland on Dec. 14, 1971 discloses a baby bottle having a removable base which includes a wind-up music box. The base is held in press-fitting engagement with the bottom of the bottle.

SUMMARY OF THE INVENTION

The present invention provides the desired sound-effect circuit combined with a drinking vessel by locating the sound-effect circuitry in the base of the drinking vessel with actuation means also located therein. The sound-generating circuit includes a battery, speaker, amplifier and digital sound chip which stores a pre-recorded sound that is reproduced upon actuation of the switch. The switch is preferably a simple, plunger-type contact switch which extends from the base of the vessel. The switch is actuated when the surface upon which the vessel is placed pushes against and moves the actuation plunger, which is spring-biased in the extended position.

More specifically, the applicant has invented a drinking vessel to be lifted from and replaced onto a supporting surface, comprising: a vessel with a top portion having an open mouth for receiving and dispensing fluid; a base of the vessel housing a sound-generating circuit; proximity switch means having "off" and "on" states electrically connected to energize the circuit for producing a sound when in the "on" state; timing means within the circuit for discontinuing the operation of the sound-generating means after a maximum time limit; means within the circuit to reset the timing means once the circuit is de-energized by the switch means; and the switch means being biased in the "off" state and held in the "on" state by the proximity of the bottom portion with the support surface, wherein the sound-generating means produces a sound only when the vessel is placed on the surface. The switch means is a plunger-type contact switch, wherein the sound-generating means produces a "burping" sound. The drinking vessel is a mug having a handle affixed to the top portion, and the top portion is releasably affixed to the base by interlocking lugs and slots.

It is therefore the primary object of the present invention to provide a drinking vessel with an amusing and entertaining sound effect which is produced as the vessel is being used. It is an object of the present invention to produce a novelty drinking vessel with self-actuated sound effects to produce a humorous and enjoyable effect upon the user. Other objects, advantages and novel features of the invention will become apparent from the following detailed description of the invention when considered in conjunction with the accompanying drawings.

BRIEF DESCRIPTION OF THE DRAWINGS

FIG. 1 is a top, front, isometric view of the drinking vessel of the present invention.

FIG. 3 is a bottom right isometric view showing the battery compartment and cover.

FIG. 4 is a side-sectional view taken from FIG. 3 as shown in that figure.

FIG. 5 is a bottom sectional view taken from FIG. 4 as shown in that figure.

DESCRIPTION OF THE PREFERRED EMBODIMENT

Referring now to FIG. 1, the novelty drinking vessel of the present invention is shown in the form of a drinking mug commonly used for brewed drinks such as beer. The upper portion of the mug includes the main drinking vessel 11 having a handle 17. At the bottom, a containment space is provided in an extended base 13 of the vessel which contains the sound effects means.

Figure 2:
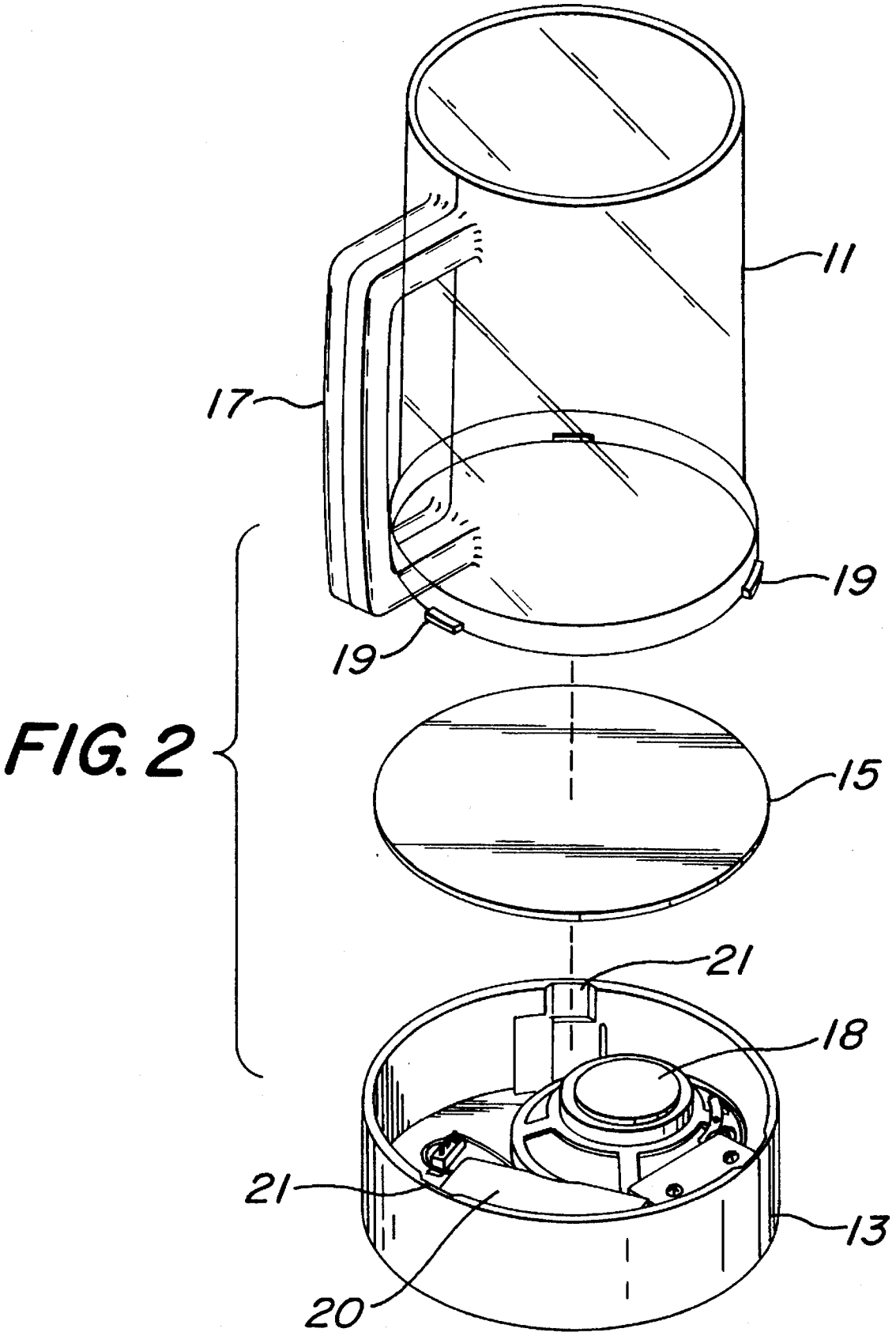
FIG. 2 is an isometric exploded assembly view of the drinking vessel shown in FIG. 1.

Referring now to FIG. 2, sound effects means include a speaker 18 and a battery 20. Also provided, but not shown in this figure, are an actuation switch, an amplifier and a digital recording sound chip. All are located within a void in the base 13 of the drinking mug. The bottom of the top portion includes lugs 19 located around its perimeter. When attached, these lugs mate with receiving slots 21 which are cut into the inside surface of the rim of the base 13 along the top. A coverplate 15 is interposed between the top portion and the base. The lugs and slots permit the base to be affixed to the top portion by a simple push-and-twist engagement between the two. This permits the components of the sound-effect means to be easily accessed, or for different styles of drinking vessels or types of bases to be easily interchanged if they all share compatible lug-and-slot securement means.

Figure 6:
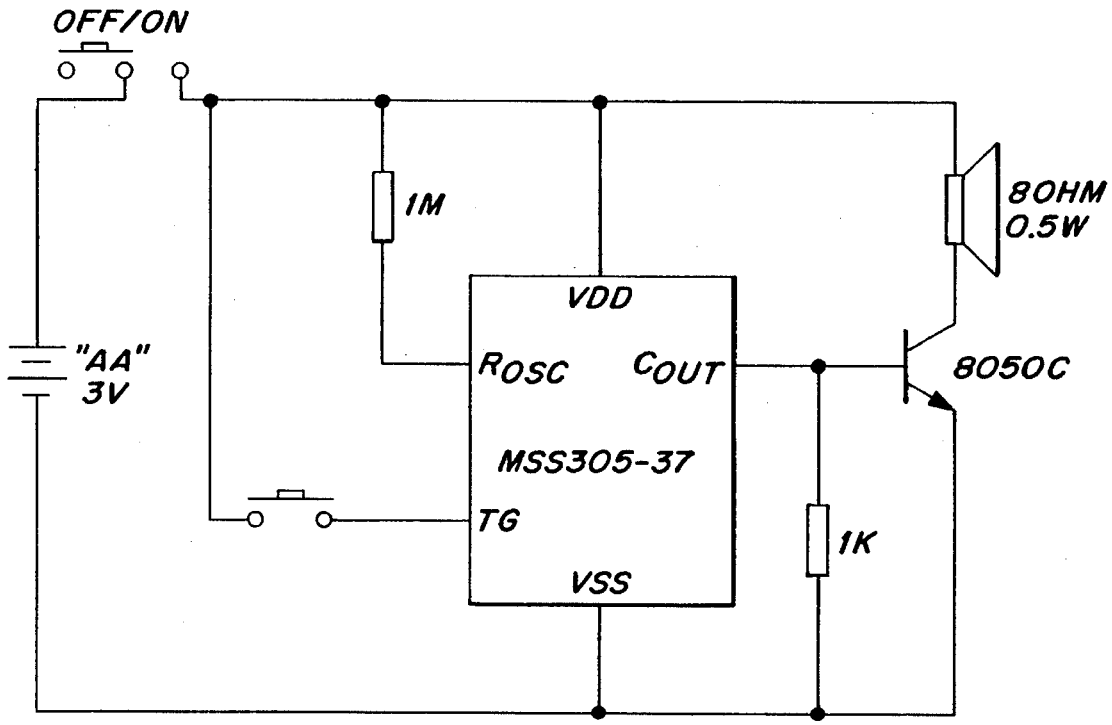
FIG. 6 is an electrical schematic diagram of the sound-generating circuit.

Referring now to FIG. 3, the switch is a simple contact switch having a plunger 25 located on the bottom of base 13 which is resiliently biased in the extended position so that when the drinking mug is placed on a flat surface, the plunger switch is depressed to close the electrical circuit between the battery and the digital sound pre-recorded chip. The recording is then reproduced by the speaker. When the mug is lifted, the plunger extends, thus changing the position of the actuation switch to open the circuit. Battery compartment 22 and battery cover 23 are also shown in this figure, together with on/off switch 27. The simple electrical circuit which further describes the sound-generating means of the present invention is shown in FIG. 6.

Referring now to FIGS. 4 and 5, greater detail of the plunger-type actuation switch is shown. Plunger 29 moves within an aperture in the base 13, and is further supported by a conical rubber boot 31 which is attached at one end to the top of the plunger and at the other end to circuit board 32.

Affixed at the top end of the plunger within the boot 31 is contact disk 33 which moves against the underside of circuit board 32 when plunger 29 is depressed. Referring now to FIG. 5, circuit board 32 includes interleaved traces which provide opposing switch contacts 35 and 37, located directly above the switch plunger. Contact disk 33 makes electrical contact between the switch contacts 35 and 37 when the plunger is depressed. When released, plunger 29 is restored to the extended position by the resilience of rubber boot 31 shown in FIG. 4.

Figure 7:
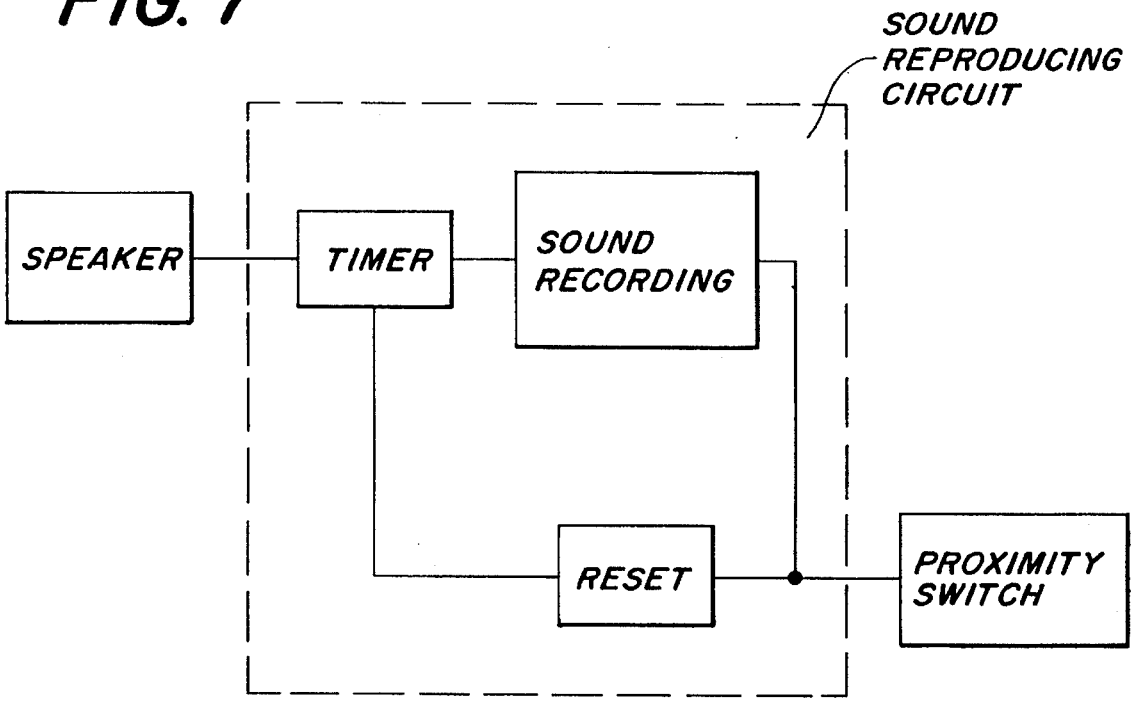
FIG. 7 is a diagram of the digital sound-generating circuitry.

In the preferred embodiment, the switch is preferably biased in the open position so that the circuit is open as the mug is lifted, and closed as it is replaced on the supporting surface. As shown diagrammatically in FIG. 7, the digital sound-producing circuit includes a timer which interrupts the sound production after a given cycle time of the reproduced sound effect. The timer is connected to reset means, which is signalled by the switch to reset the timer when the switch is changed to the "off" state and the electrical circuit is open. According to this arrangement, the sound effect will be produced each time the drinking mug is put down onto the table. One cycle of the sound effect is then played and stopped by the timer. Once the mug is lifted from the table top, the switch is opened again and the timer is reset.

Thus, the recording is only played after the mug has once again been put down, closing the circuit. In this way the sound is produced only as the mug is placed on the table top, but not as it is lifted. When used with a particular sound effect of the present invention, this occurrence of the sound produces a particularly humorous result because the recorded sound is a bodily gastric belching or burping sound, commonly associated with beer drinking in a comedic way. Thus, this presentation of the recording at this time can also surprise the drinker, giving the sound effect yet greater effect and impact. It should also be understood that although the recording chip in the preferred embodiment produces a human "burping" sound effect, any other type of recorded sound may be played, including, for example, a slogan, jingle or other words.

The present invention may be made of many different materials and the particular types of devices used in the sound-generating circuitry may be of any type which is readily available and commonly used in the electrical arts. It should be understood that the above description discloses specific embodiments of the present invention and are for purposes of illustration only. There may be other modifications and changes obvious to those of ordinary skill in the art which fall within the scope of the present invention and should be limited only to the following claims and their legal equivalents.

What is claimed is:

1. A drinking vessel, to be lifted from and replaced onto a supporting surface, comprising:

a vessel with a top portion having an open mouth for receiving and dispensing fluid;

a base at the bottom of said vessel housing a sound-generating circuit;

proximity switch means having "off" and "on" states electrically connected to a power source to energize said circuit for producing a sound when in the "on" state;

timing means within said circuit for discontinuing the operation of said sound-generating means after a maximum time limit;

means within said circuit to reset said timing means once said circuit is de-energized by said switch means; and said switch means being biased in the "off" state and held in the "on" state by the proximity of said base with said support surface, wherein the sound-generating means produces a sound only when said vessel is placed on said surface.

2. The drinking vessel of claim 1, wherein said switch means is a plunger-type contact switch.

3. The drinking vessel of claim 2, wherein said sound is a "burping" sound.

4. The drinking vessel of claim 3, wherein said vessel is a mug having a handle affixed to said top portion.

5. The drinking vessel of claim 3, wherein said top portion is releaseably affixed to said base.

6. The drinking vessel of claim 5, wherein said top portion includes a plurality of lugs located around the perimeter at the bottom of said top portion which interlock with cooperating receiving slots located on the inside surface of the rim of said base.

7. The drinking vessel of claim 6, further including a coverplate interposed between said top portion and said base.

* * * * *